US006708524B1

(12) United States Patent
Masubuchi

(10) Patent No.: US 6,708,524 B1
(45) Date of Patent: Mar. 23, 2004

(54) ACCESSORY COATABLE WITH NAIL POLISH

(75) Inventor: Motonori Masubuchi, Tokyo (JP)

(73) Assignee: Miki Corporation, Tokyo (JP)

( * ) Notice: Subject to any disclaimer, the term of this patent is extended or adjusted under 35 U.S.C. 154(b) by 0 days.

(21) Appl. No.: 09/594,391

(22) Filed: Jun. 15, 2000

(30) Foreign Application Priority Data

Feb. 28, 2000 (JP) ..... 2000-051816

(51) Int. Cl.[7] ..... A44C 5/00

(52) U.S. Cl. ..... 63/3; 63/12; 63/15; 63/20; 63/33

(58) Field of Search ..... 63/12, 3, 15, 20, 63/33, 34, 42

(56) References Cited

U.S. PATENT DOCUMENTS 4,388,350 A * 6/1983 Ayers ..... 427/262
4,753,828 A * 6/1988 Francis et al. ..... 427/260
5,857,512 A * 1/1999 Engel ..... 164/15

FOREIGN PATENT DOCUMENTS

| | | |
|---|---|---|
| DE | 9415442 | 12/1994 |
| FR | 564406 | 12/1923 |
| FR | 2029110 | 10/1970 |
| JP | 63-166015 | 10/1988 |
| JP | 2000-116419 | 4/2000 |

* cited by examiner

*Primary Examiner*—Anthony Knight
*Assistant Examiner*—Andrea Chop
(74) *Attorney, Agent, or Firm*—Jordan and Hamburg LLP

(57) ABSTRACT

An accessory coatable with nail polish such as a finger ring, a pendant head, a clip earring, an earring for a pierced ear, a bracelet and an anklet has at least one pattern surrounded by a circular line at a position which is outstanding when worn. The pattern is partitioned from a base by a gently-sloping concave boundary portion. The process of applying the nail polish onto the inside of the pattern and removing the nail polish is repeatable. This makes it possible to arrange on the accessory a pattern having a color identical to or consistent with that of nail polish applied onto nails such that color-coordinated personal adornment can be enjoyed.

23 Claims, 2 Drawing Sheets

FIG. 3

ACCESSORY COATABLE WITH NAIL POLISH

BACKGROUND OF THE INVENTION

The present invention relates to an accessory coatable with nail polish, and more particularly to an accessory such as a finger ring, a pendant head, a clip earring, an earring for a pierced ear, a bracelet or an anklet, which is coatable in a pattern thereon with nail polish identical to or consistent in color with nail polish applied onto nails, thereby securing color coordination between the accessory and the nail polish.

The invention further relates to a method of using the accessory.

Recently, the color of nail polish has been diversified, and accessories such as finger rings, pendants, clip earrings and earrings for pierced ears can be color-coordinated with a nail polish by giving a part of each accessory a color identical to or consistent with that of the nail polish. Thus, the use of these accessories and the varieties of personal adornment are also significantly expanded.

SUMMARY OF THE INVENTION

The accessory of the present invention is at least one accessory selected from the group consisting of a finger ring, a pendant head, a clip earring, an earring for a pierced ear, a bracelet and an anklet, and has at least one pattern surrounded by a circular line at a position which is outstanding when worn. The pattern is partitioned from a base metal by a gently-sloping sunken convex portion including a region that continuously rises toward a center of the pattern with no stepwise difference in level so as to give a height approximately identical with or higher than that of the base metal portion adjacent to the pattern. The pattern may be a raised convex portion from the base metal portion. An inner pattern surrounded by a circular line may be further formed in the inside of the pattern, and provided with a raised convex portion or a gently-sloping sunken convex portion in an intermediate portion between the pattern and the inner pattern. No stepwise difference in level is formed in the pattern so that the operation of applying nail polish or removing nail polish can be repeated.

That is to say, according to the invention, the pattern coatable with nail polish is arranged at an outstanding position of an accessory such as a finger ring, a pendant head, a clip earring, an earring for a pierced ear, a bracelet or an anklet, and is coated with nail polish identical to or consistent in color with nail polish applied onto nails. As a result, a color identical to or consistent with that of the nail polish can be given to an accessory such as a finger ring or a pendant such that consistent personal adornment is enjoyed.

For applying the nail polish onto the accessory, the accessory itself must be produced so that the coating and removal of nail polish can be easily conducted. Accordingly, the pattern suitable for the coating of nail polish is a pattern surrounded by a circular line. This pattern portion, that is to say, the portion to be coated with nail polish, is preferably formed in a sunken convex or raised convex shape with respect to the base metal portion.

In the figures, densely dotted areas represent faces coated with nail polish.

DETAILED DESCRIPTION OF THE INVENTION

In the present invention, the accessory is a finger ring, a pendant head, a clip earring, an earring for a pierced ear, a bracelet or an anklet. Accessories are generally produced by the combination of noble metals and various gems. According to the present invention, however, it is preferred that main decoration areas of the accessories are mainly formed of metals. Materials for the accessories are required to be ones that are not deteriorated with nail polish or solvents of polish removers.

A pattern 2 surrounded by a circular line 1 may be of any shape such as a circle, a quadrilateral, a triangle, a heart shape or a wide cross shape. Various patterns can be formed by the combination of straight lines and various curved lines. The pattern 2 is required to be a pattern surrounded by a circular line 1, because the nail polish is applied onto the inside of the pattern, and the circular line 1 surrounding the pattern 2 can be in a variety of forms. However, a narrow groove having a width of 1 mm or less and a line curved at an acute angle are unfavorable because of difficulty in applying and removing the nail polish.

Figure 1:
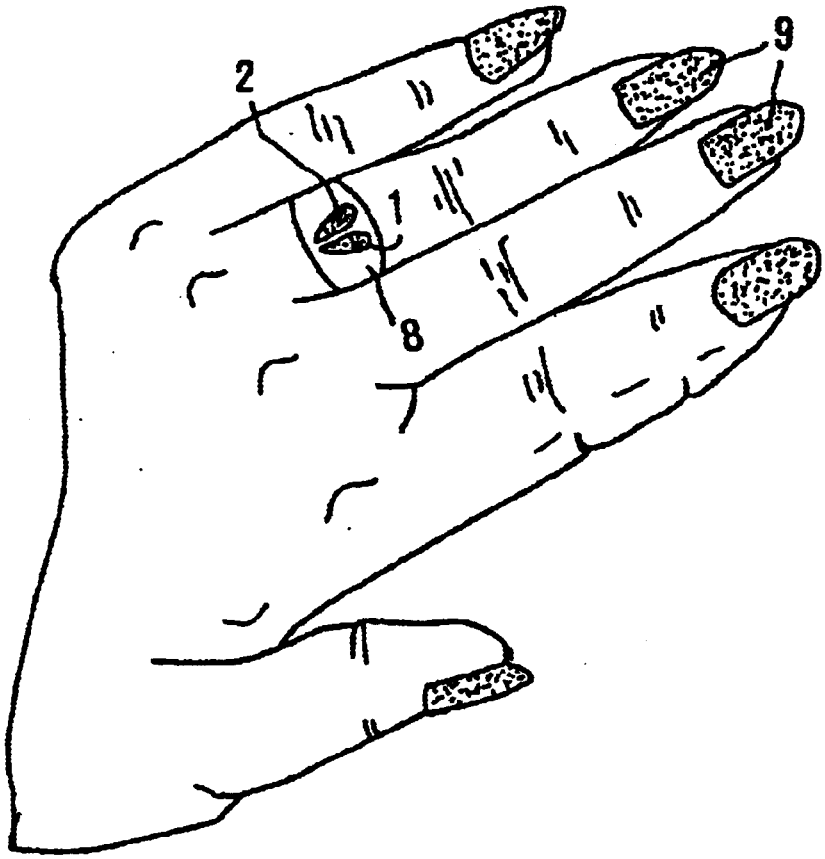
FIG. 1 is a perspective view showing a finger ring of the present invention worn on a finger, a pattern of the finger being coated with the same nail polish as that put on a nail of the finger.
Figure 2:
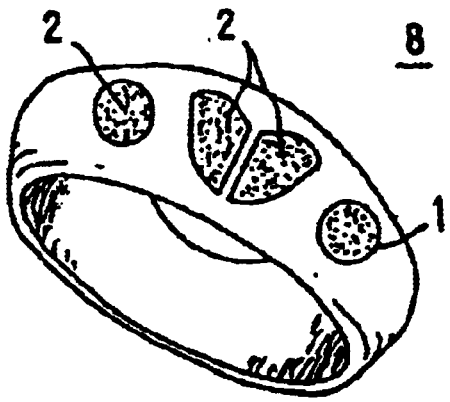
FIG. 2 is a perspective view showing another finger ring of the present invention.
Figure 5:
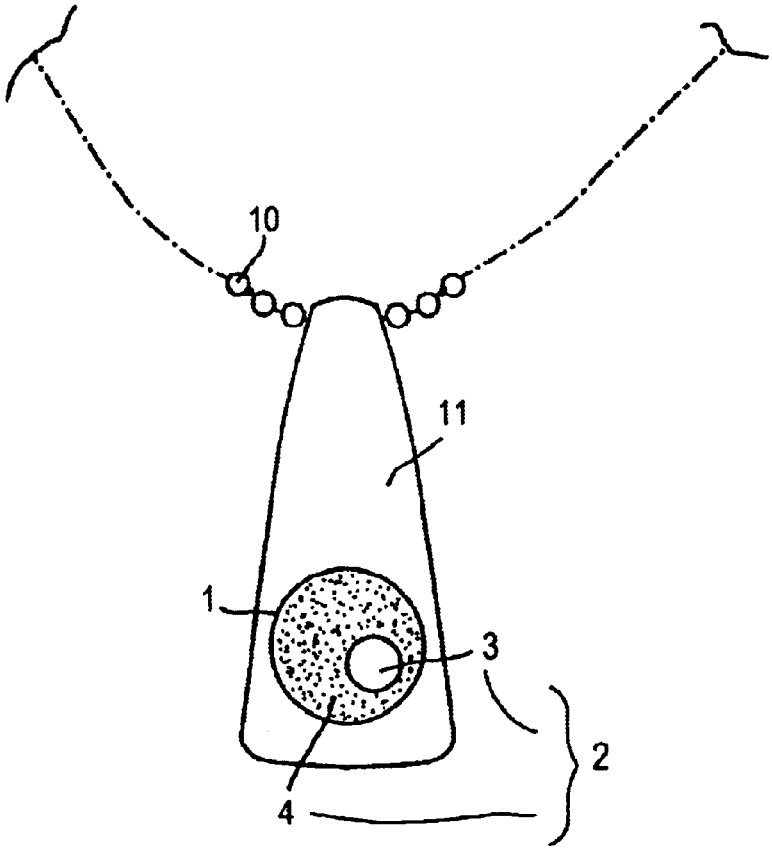
FIG. 5 is a plan view showing a main portion of a pendant.

FIG. 1 shows patterns in which a heart-shaped pattern is divided into two parts by a straight line at a center portion thereof to form two patterns 2 each surrounded by circular lines 1 obtained by the combination of straight lines and curved lines. FIG. 2 shows a finger ring 8 on which four patterns 2 each surrounded by circular lines 1 are arranged. Further, as shown in FIG. 5, in a pattern 2 surrounded by a circular line 1, an inner pattern 3 surrounded by a circular line, which is smaller in diameter than the pattern 2, can also be present. In this case, the patterns are surrounded by double lines. Accordingly, an intermediate portion 4 is formed between the pattern 2 and the inner pattern 3, and the intermediate portion 4 can also be coated with the nail polish. Further, in the inner pattern 3, at least one small gem can be embedded, or a special decoration treatment can be performed. It is also possible to arrange two or more inner patterns 3 in the pattern 2.

Figure 3:
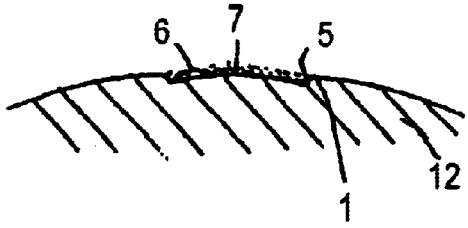
FIG. 3 is an enlarged cross sectional view showing a sunken convex pattern.

When the inside of the pattern 2 is coated with the nail polish 6, it is necessary to clearly distinguish a portion to be coated with the nail polish from a portion not to be coated. Therefore, the pattern side of the circular line 1 is formed in a sunken convex shape. The formation of a sunken convex portion steeply sloping from the circular line 1 causes the tendency of the nail polish to remain in the steeply-sloping sunken convex portion when the nail polish is removed with a polish remover after the application of the nail polish. Accordingly, a gently-sloping boundary portion 5 is formed at a site shifting from the circular line to the pattern, as shown in FIG. 3. The reference numeral 6 indicates nail polish. The depth of the sunken convex portion is from 0.1 mm to 1.0 mm, and preferably from 0.2 mm to 0.8 mm.

Figure 4:
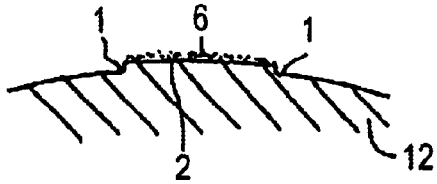
FIG. 4 is an enlarged cross sectional view showing a raised convex pattern.

Further, a coating surface of the nail polish tends to contract after being dried, so that a rising portion 7 gently sloping toward a center of the sunken convex portion with no stepwise difference in level is preferably formed as shown in FIG. 3. The height of the rising portion 7 is preferably identical with or higher than that of a base metal 12. The formation of the rising portion 7 gives a three-dimensional effect to the coating surface of the nail polish. In order to emphasize a rising effect of the coating surface of the nail polish, the pattern 2 is optionally raised and convexly curved from the circular line 1, as shown in FIG. 4, and the raised convex portion can also be further allowed to rise toward a center of the pattern 2. The reference numeral 12 indicates a base metal.

When the nail polish 6 is applied onto the inside of the pattern 2, the nail polish is carefully applied within the circular line 1. With either a sunken convex portion or a raised convex portion, when the nail polish protrudes from the circular line 1, a site at which the nail polish crosses over the circular line 1 is rubbed with absorbent cotton impregnated with a polish remover. After drying of the nail polish, a clear boundary line is thereby obtained.

EXAMPLES

Magenta-colored red nail polish 6 having a pearly luster was applied onto nails, and the same nail polish was applied onto the sunken convex portion of the finger ring 8. As shown in FIG. 1, the nails 9 and the finger ring are outstanding in the magenta color having the pearly luster to present a beautiful color-coordinated appearance. Further, the same nail polish was also applied onto the intermediate portion 4 of the pendant shown in FIG. 5. Consequently, a more polished personal adornment could be enjoyed. In FIG. 5, the reference numeral 10 indicates a chain, and the reference numeral 11 indicates a pendant head.

Two days later, the nail polish applied onto the nails, the finger ring and the pendant head was removed with a polish remover. The nail polish on the accessories could also be easily removed, in a manner similar to the removal of the nail polish on the nails, and no magenta color remained in the vicinity of the circular line 1. Green nail polish was applied again onto the patterns 2 of the same finger ring and pendant, as well as the nails. Further, the nail polish was also applied onto a pattern of an earring for a pierced ear. As a consequence, color-coordinated personal adornment could be enjoyed.

What is claimed is:

1. An accessory comprising:

at least one component selected from the group consisting of a finger ring, a pendant head, a clip earring, an earring for a pierced ear, a bracelet and an anklet, said component having a base metal member, and said base metal member having:

an uncoated region, at least one pattern region, said at least one pattern region being in the form of a sunken convex region sunken into a surface contour of said base metal member and said at least one pattern region having a surface for permitting application and removal of a removable coating, and a removable coating applied to the surface of the least one pattern region.

2. The accessory according to claim 1, wherein said at least one pattern region has a center region with a height equal to or greater than the uncoated region.

3. The accessory according to claim 1, wherein said at least one pattern region is surrounded by at least one of straight lines and curved lines.

4. The accessory according to claim 1, wherein said sunken convex region is gently sloping.

5. The accessory according to claim 1, wherein a deepest region of said sunken convex region is 0.1 mm to 1.0 mm.

6. The accessory according to claim 1, wherein a deepest region of said sunken convex region is 0.2 mm to 0.8 mm.

7. The accessory according to claim 1, wherein said at least one pattern region includes an inner pattern.

8. The accessory according to claim 7, wherein said inner pattern is surrounded by a circular line.

9. A method of using an accessory coatable with a removable coating comprising:

providing an accessory which is at least one selected from the group consisting of a finger ring, a pendant head, a clip earring, an earring for a pierced ear, a bracelet and an anklet, said accessory having an uncoated region, and at least one sunken convex region sunken into a surface contour of said accessory, said at least one sunken convex region having a surface for application and removal of a removable coating;

applying a removable coating to the at least one sunken convex region; and removing the removable coating from the at least one sunken convex region.

10. The method of using an accessory coatable with a removable coating according to claim 9, wherein said at least one sunken convex region has a center region with a height equal to or greater than the uncoated region.

11. The method of using an accessory coatable with a removable coating according to claim 9, wherein said at least one sunken convex region is surrounded by at least one of straight lines and curved lines.

12. The method of using an accessory coatable with a removable coating according to claim 9, wherein said at least one sunken convex region is gently sloping.

13. The method of using an accessory coatable with a removable coating according to claim 9, wherein a deepest region of said at least one sunken convex region is 0.1 mm to 1.0 mm.

14. The method of using an accessory coatable with a removable coating according to claim 9, wherein a deepest region of said at least one sunken convex region is 0.2 mm to 0.8 mm.

15. The method of using an accessory coatable with a removable coating according to claim 9, wherein said at least one sunken convex portion includes an inner pattern.

16. The method of using an accessory coatable with a removable coating according to claim 15, wherein said inner pattern is surrounded by a circular line.

17. An accessory comprising:

at least one component selected from the group consisting of a finger ring, a pendant head, a clip earring, an earring for a pierced ear, a bracelet and an anklet, said component having a base metal member, said base metal member having:

an uncoated region, at least one pattern region, said at least one pattern region being in the form of a sunken convex region sunken into a surface contour of said base metal member, said at least one pattern region having a surface for permitting application and removal of a removable coating, a joining region which is substantially perpendicular to the uncoated region joining the uncoated region and the at least one pattern region, and a removable coating applied to said at least one pattern region, wherein a height of a central point of the at least one pattern region is equal to or greater than a height of the uncoated region.

18. The accessory according to claim 17, wherein said at least one pattern region is surrounded by at least one of straight lines and curved lines.

19. The accessory according to claim 17, wherein said sunken convex region is gently sloping.

20. The accessory according to claim 17, wherein a deepest region of said sunken convex region is 0.1 mm to 1.0 mm.

21. The accessory according to claim 17, wherein a deepest region of said sunken convex region is 0.2 mm to 0.8 mm.

22. The accessory according to claim 17, wherein said at least one pattern region includes an inner pattern.

23. The accessory according to claim 22, wherein said inner pattern is surrounded by a circular line.

* * * * *